US005963895A

United States Patent [19]

Taori et al.

[11] Patent Number: 5,963,895

[45] Date of Patent: Oct. 5, 1999

[54] TRANSMISSION SYSTEM WITH SPEECH ENCODER WITH IMPROVED PITCH DETECTION

[75] Inventors: Rakesh Taori; Robert J. Sluijter; Eric Kathmann, all of Eindhoven, Netherlands

[73] Assignee: U.S. Philips Corporation, New York, N.Y.

[21] Appl. No.: 08/645,544

[22] Filed: May 10, 1996

[30] Foreign Application Priority Data

May 10, 1995 [EP] European Pat. Off. ..... 95201199

[51] Int. Cl.[6] ..... G10L 9/08

[52] U.S. Cl. ..... 704/207; 704/216

[58] Field of Search ..... 395/2.25, 2.16, 395/2.17, 2.26, 2.27; 704/216, 207, 208, 217, 218, 205, 209

[56] References Cited

U.S. PATENT DOCUMENTS

| | | | |
|---|---|---|---|
| 3,676,595 | 7/1972 | Dolansky et al. | 704/276 |
| 4,310,721 | 1/1982 | Manley et al. | 395/2.09 |
| 4,561,102 | 12/1985 | Prezas | 395/2.16 |
| 4,803,730 | 2/1989 | Thomson | 395/2.16 |
| 4,879,748 | 11/1989 | Picone et al. | 381/49 |
| 5,012,517 | 4/1991 | Wilson et al. | 395/2.16 |
| 5,042,069 | 8/1991 | Chhatwal et al. | 395/2.16 |
| 5,127,053 | 6/1992 | Koch | 395/2.16 |
| 5,233,660 | 8/1993 | Chen | 395/2.16 |
| 5,774,837 | 6/1998 | Yeldener et al. | 704/208 |

FOREIGN PATENT DOCUMENTS

0393614A1 10/1990 European Pat. Off. ..... G10L 9/14

OTHER PUBLICATIONS

"An accurate pitch detection algorithm", Y. Medan et al., 9th International Conference on Pattern Recognition, vol. 1, pp. 476–480, see pp. 476–479.

"Super resolution pitch determination of speech signals", Y. Medan et al, IEEE Trans. on Acoustics, Speech and signal processing, vol. ASSP–39, No. 1, 1991, pp. 40–48, see pp. 42–43; Introduction.

*Primary Examiner*—Richemond Dorvil
*Attorney, Agent, or Firm*—Jack D. Slobod

[57] ABSTRACT

A transmission system contains a speech coder which utilizes a pitch detector that is arranged to select a characteristic auxiliary signal portion from the signal to be coded in order to improve the quality of the pitch detection. The pitch is found by searching in the speech signal for signal portions that correspond to the characteristics auxiliary signal portion and by calculating the time difference between the respective signal portions.

20 Claims, 3 Drawing Sheets

TRANSMISSION SYSTEM WITH SPEECH ENCODER WITH IMPROVED PITCH DETECTION

BACKGROUND OF THE INVENTION

1. Field of the Invention

This invention relates to a transmission system comprising a transmitter with an encoder for deriving a coded signal from a quasi-periodic signal, the transmitter being arranged for transmitting the coded signal to a receiver via a medium, the encoder comprising a pitch detector for deriving pitch information from the quasi-periodic signal.

The invention likewise relates to an encoder, a detector for detecting the period of a quasi-periodic signal and a method of pitch detection.

2. Description of the Prior Art

A pitch detector to be used in a transmission system as defined in the opening paragraph is known from the journal article "Automatic and Reliable Estimation of Glottal Closure Instant and Period" by Y. M. Cheng and D. O. Shaughnessy, IEEE Transactions on Acoustics, Speech and Signal Processing, Vol. ASSP-23, pp. 418–423, 1976.

Such transmission systems are used, for example, for transmitting speech signals by a transmission medium such as a radio channel, a coaxial cable or a glass fibre. Alternatively, such transmission systems may be used for storing speech signals on a storage medium such as a magnetic tape or disc. Applications are, for example, automatic telephone answer machines and dictating machines.

A speech signal consists of voiceless and voiced components. A voiceless component of a speech signal occurs when some consonants are pronounced and do not show any periodicity. A voiced component of a speech signal occurs when vowels are pronounced and is more or less periodic. Such a signal is also termed quasi-periodic. An important parameter of such a signal is the period, usually called pitch. For various types of speech encoders it is of great importance to calculate accurately the pitch of the voiced components of the speech signal.

A first method of determining the pitch is calculating the autocorrelation function of the quasi-periodic signal, the pitch information being represented by the difference of the delay between two peaks of the autocorrelation function. A problem is then that a single pitch value is calculated over a signal segment that has a given time duration. Any variations of the pitch in the given time duration cannot be measured, but lead only to an (undesired) widening of the peaks of the autocorrelation function.

In the pitch detector known from said journal article, the pitch information is derived from a cross-correlation function between the speech signal and a modelled response of the human speech system to an excitation signal that is caused by the closing of the vocal cords. The properties of the human speech system are described by linear prediction parameters derived from the speech signal. From this cross-correlation function is derived a signal in which peaks occur that indicate the excitation instants. The average value of this signal is subtracted from this signal and clipped, so that a pulse-shaped signal is obtained in which the pulses denote the excitation instants. It appears that pulses may be lost in signals having a non-constant pitch, or secondary pulses may appear as a result of the average value being temporarily too high or too low. This will lead to a reduced reliability of the pitch detection.

SUMMARY OF THE INVENTION

It is an object of the invention to provide a transmission system as desired in the opening paragraph in which the quasi-periodic signal need not be stationary for a reliable pitch detection.

For this purpose, the invention is characterized in that the pitch detector comprises selecting means for selecting a characteristic portion of an auxiliary signal, referred to hereafter as the "characteristic auxiliary signal portion", which auxiliary signal is representative of the quasi-periodic signal, search means for searching for at least a further signal portion of the auxiliary signal that sufficiently corresponds to the characteristic auxiliary signal portion, and means for deriving the pitch information from the instants at which the characteristic auxiliary signal portion and the further signal portion occur.

By selecting a characteristic auxiliary signal portion from the auxiliary signal, and searching for at least a further auxiliary signal portion of the auxiliary signal that sufficiently corresponds to the characteristic auxiliary signal portion, it is possible to obtain pitch information without the need for utilizing the stationarity of the quasi-periodic signal.

An additional advantage of the invention is that no linear prediction parameters need be calculated, so that the pitch detector according to the invention will be simpler than the state of the art pitch detector. A further additional advantage is that erroneous pitch detection, which occurs if two excitation pulses are present in one pitch period, is avoided. For that matter, it has appeared that two excitation instants regularly occur in one pitch period in speech signals. In such a situation the state of the art pitch detector, in which excitation instants are searched for, will calculate the pitch period erroneously. Since the pitch detector according to the invention does not search for excitation instants, but the repeated occurrence of a characteristic auxiliary signal portion, this erroneous calculation of the pitch period will not occur.

An embodiment of the invention is characterized in that the characteristic auxiliary signal portion comprises a signal portion that has maximum energy over a specific time segment.

A suitable characteristic auxiliary signal portion is an auxiliary signal portion whose energy is maximized over a specific time segment. Such a signal portion may be simply found by searching for a maximum running energy function value. The running energy function value may be calculated by performing a non-linear operation of the auxiliary signal which operation is described by an even function, and integrating the result of this operation over a specific time interval. Suitable even functions are $f(x)=x^2$ and $f(x)=|x|$. An alternative manner of finding a characteristic auxiliary signal portion is searching for the maximum value of the auxiliary signal in a specific time segment. Generally, auxiliary signal portions having a maximum strength are suitable to act as a characteristic auxiliary signal portion.

A further embodiment of the invention is characterized in that the time duration of the characteristic auxiliary signal portion is smaller than or equal to the briefest occurring pitch period.

A suitable characteristic auxiliary signal portion is a pitch period or a significant part thereof. By taking a characteristic auxiliary signal portion of about the briefest pitch period in length, a suitable characteristic auxiliary signal portion can be found for most situations. It is conceivable that the length of the auxiliary signal portion is selected in dependence on the occurring pitch period, so that an adaptive system is obtained.

A further embodiment of the invention is characterized in that the search means comprise correlation means for calculating the correlation between the characteristic auxiliary signal portion and the auxiliary signal, the pitch information being represented by the position of the peaks in the correlation function.

A simple manner of searching for a further auxiliary signal portion that corresponds to the characteristic auxiliary signal portion is calculating the cross-correlation function between the characteristic auxiliary signal portion and the auxiliary signal. The pitch information is then represented by the position of the maxima of the cross-correlation function. The pitch period may be calculated from the time difference between two consecutive maxima of the cross-correlation function.

A further embodiment of the invention is characterized in that the pitch detector comprises means for calculating the surface of the peaks in the correlation function, the pitch detector being arranged for deriving the pitch information from the surface of the peaks of the correlation function plotted against time.

Experiments have shown that the cross-correlation function of the characteristic auxiliary signal portion and the auxiliary signal shows not only desired peaks, but also undesired secondary peaks which have a smaller width than the desired peaks. By representing the pitch information by pulses having an amplitude that is proportional to the surface of the corresponding peak in the autocorrelation function, it becomes simpler to distinguish between the desired and undesired peaks. The distinction may be further simplified by utilizing an expanded surface value in lieu of the surfaces. A suitable manner of obtaining the expanded surface value is multiplying the surface of a peak by the maximum value of the respective peak.

It should be observed that the invention is not restricted to pitch detection in speech signals, but that it may also be applied to situations where a delay between two or more signal components is to be determined. Examples of this are the separation of a multiplicity of sources which may occur in systems for background noise suppression and beam formation in radar systems. In such an application it may happen that the quasi-periodic signal has not more than two periods.

These and other aspects of the invention will be apparent from and elucidated with reference to the embodiments described hereinafter.

BRIEF DESCRIPTION OF THE DRAWINGS

For a fuller understanding of the invention, reference is had to the following description taken in connection with the following drawings, in which.

DETAILED DESCRIPTION OF THE PREFERRED EMBODIMENTS

Figure 1:
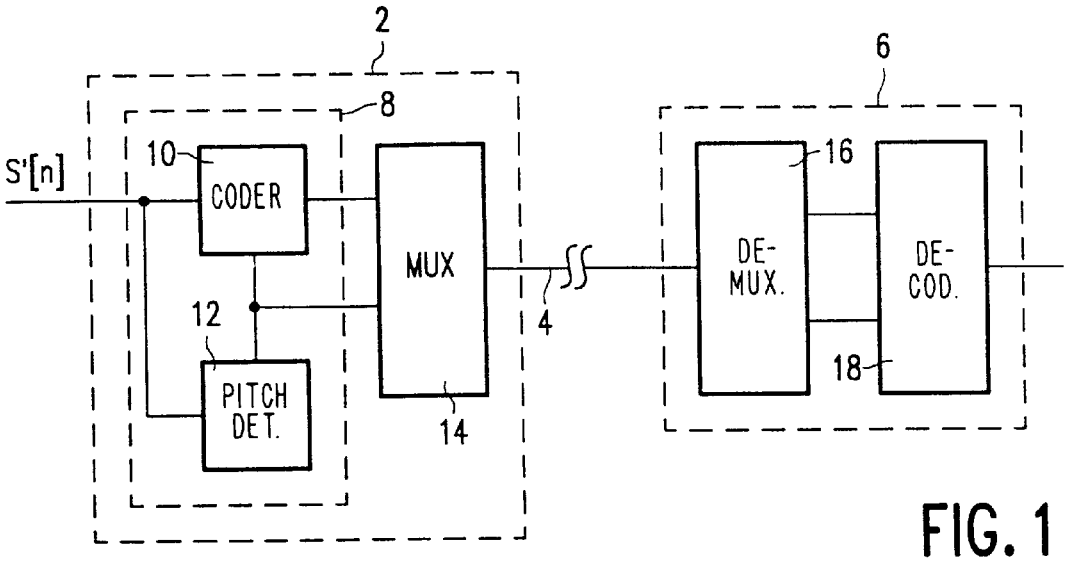
FIG. 1 shows a transmission system in which the invention is applied.

In the transmission system shown in FIG. 1, a digital speech signal S'[n] is applied to a transmitter 2. In this transmitter 2 the speech signal S'[n] is applied to an encoder in which it is applied to a pitch detector 12 and to pitch-synchronous coding means 10. An output of the pitch detector 12, which carries the pitch information as its output signal, is connected to an input of a multiplexer 14 and to a first input of the pitch-synchronous coding means 10. An output of the pitch-synchronous coding means 10 is connected to a second input of the multiplexer 14. The output of the multiplexer 14 is coupled to the output of the transmitter 2.

The output of the transmitter 2 is connected by the channel 4 to the input of a receiver 6. The input of the receiver 6 is connected to an input of a demultiplexer 16. A first output of the demultiplexer is connected to a first input of a pitch-synchronous decoder 18. A second output of the demultiplexer 16, which carries the pitch information as its output signal, is connected to a second input of the pitch-synchronous decoder 18. An output of the pitch-synchronous decoder 8, which carries the reconstructed speech signal as its output signal, is connected to the output of the receiver 6.

In the transmission system shown in FIG. 1, the pitch information is derived from the quasi-periodic speech signal by the pitch detector 12. This pitch information is used by the pitch-synchronous encoder 10 to reduce the necessary transmission capacity for the coded signal. Examples of the pitch-synchronous encoder 10 are described in the journal articles "A glottal LPC-vocoder" by P. Hedelin in Proceedings of the International Conference of the IEEE, ASSP '84, San Diego, 1984 and "Encoding Speech Using Prototype Waveforms" by W. B. Kleyn in IEEE Transactions on Speech and Audio processing, Vol. 1, No. 4, October 1993.

The coded speech signal and the pitch information are combined to a single coded output signal by the multiplexer 14. This coded output signal is transmitted to the receiver 6 by the transmission channel 4.

In the receiver 6 the received signal is detected and converted into a digital signal. This digital signal is demultiplexed by the demultiplexer 16 into a coded signal and a signal representing pitch information. The pitch-synchronous decoder 18 derives the reconstructed speech signal from the coded signal and the pitch information. This reconstructed speech signal is available on the output of the receiver 6.

Figure 2:
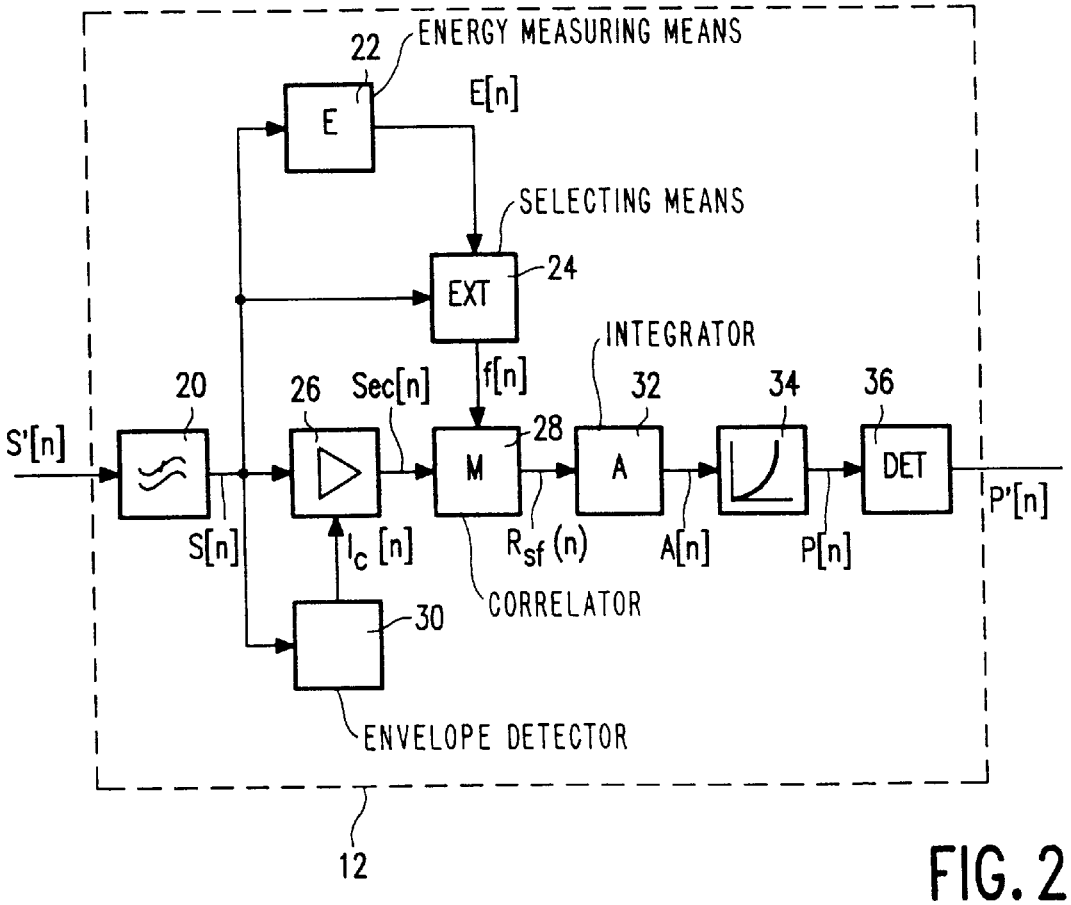
FIG. 2 shows an embodiment of the pitch detector according to the invention.

In the pitch detector shown in FIG. 2, the quasi-periodic signal S'[n] is applied to a low-pass filter 20. The output of the low-pass filter 20, which carries the auxiliary signal S[n] as its output signal, is connected to an input of energy measuring means 22, to a first input of selecting means 24 and to an input of an envelope detector 30.

The output of the energy measuring means 22, which carries an output signal E[n], is connected to a second input of the selecting means 24. The output of the selecting means 24, which carries the characteristic auxiliary signal portion f[n] as its output signal, is connected to a first input of the search means formed here by a correlator 28. The output of the controllable amplifier 26, which carries output signal $S_{ec}[n]$, is connected to a second input of the correlator 28. An output of the envelope detector 30, which carries a control signal $e_c[n]$, is connected to a control input of the controllable amplifier 26. The controllable amplifier 26 and the envelope detector 30 together form the amplitude control means.

The output of the correlator 28, which carries an output signal $R_{sf}[n]$, is connected to an integrator 32. The output of the integrator 32, which carries output signal A[n], is connected to an input of expansion means 34, while the output of the expansion means 34, which carries output signal P[n], is connected to an input of a detector 36. On the output of the detector 36 is available the pitch information in the form of the signal P'[n].

The speech signal that is digitally represented by the signal S'[n] is filtered by the low-pass filter 20 with the purpose of stripping the signal of signal components that have a relatively high frequency and may have a disturbing effect on the pitch detection. The cut-off frequency of the low-pass filter 20 is selected so that it lies beyond the highest possible pitch frequency. A value that has turned out to be usable in practice is 600 Hz.

The energy measuring means 22 calculate a running energy function of an M-sample-long auxiliary signal portion for a segment that has a length of N samples. A segment duration proved suitable is, for example, 40 ms, while a duration of 2 ms is suitable for the running energy function. With an 8 kHz sampling frequency, N is equal to 320 and M is equal to 16. For the signal E[n] there may be written:

$$E[n] = \sum_{k=0}^{M} S^2[n+k] \qquad 0 \le n \le N - M \tag{1}$$

The characteristic auxiliary signal portion is now the auxiliary signal portion whose running energy function E[n] is maximum. Thus, assuming that E[n] is maximum for $n=n_m$, the characteristic auxiliary signal portion f[n] is equal to:

$$f[n] = \begin{cases} 0, & n < n_m \\ S[n], & n_m \le n \le n_m + M \\ 0, & n > n_m + M \end{cases} \tag{2}$$

This auxiliary signal portion f[n] is derived from the signal S[n] by the selecting means 24 while the value $n_m$ calculated from E[n] is utilized. The correlator 28 calculates the cross-correlation function $R_{sf}[n]$ of the amplitude control signal $S_{ec}[n]$ which is available on the output of the controllable amplifier 26. For this correlation function $R_{sf}[n]$ then holds:

$$R_{sf}[n] = \sum_{k=0}^{M} \mathrm{MAX}\{f(k) \cdot S_{ec}[n+k], 0\}, \qquad \frac{M}{2} \le n \le N - \frac{M}{2} \tag{3}$$

(3) may also be written as:

$$R_{sf}[n] = \sum_{k=0}^{M} \mathrm{MAX}\{S[n_m + k] \cdot S_{ec}[n+k], 0\}, \qquad \frac{M}{2} \le n \le N - \frac{M}{2} \tag{4}$$

The MAX function is used in (3) and (4) to avoid the occurrence of negative values of $R_{sf}[n]$. These negative correlation values do not have any importance when signal portions corresponding to the characteristic auxiliary signal portion are searched for.

A signal A[n] which is a measure of the surface of the peak that belongs to the respective value of n in the cross-correlation function $R_{sf}[n]$ is derived by the integrator 32. The $k^{th}$ peak in the cross-correlation function may be described as:

$$L_k[n] = \begin{cases} 0, & n < b_k \\ R_{sf}[n], & b_k \le n \le e_k \\ 0, & n > e_k \end{cases} \tag{5}$$

$b_k$ and $e_k$ denote the beginning and end of the $k^{th}$ peak of the autocorrelation function. For the surface $A_k$ of the $k^{th}$ peak now holds:

$$a_k = \sum_{i=b_k}^{e_k} L_k[i] \tag{6}$$

The value of $n_k$ that belongs to $a_k$ is the value of n that belongs to the maximum $m_k$ of the peak $L_k[n]$. For $m_k$ then holds:

$$m_k = \mathrm{MAX}\{L_k[n]\} \tag{7}$$

The surface A is scaled by utilizing the largest value of $a_k$, so that the value A[n] is smaller than or equal to one. For the function A[n] may then be found:

$$A[n] = \begin{cases} \dfrac{a_k}{\mathrm{MAX}(a_1, \cdots a_q)}, & n = n_k \\ 0, & n \ne n_k \end{cases} \tag{8}$$

In (8), q is the number of peaks in a signal segment. The transformation of the function $R_{sf}[n]$ into the function A[n] results in a relative attenuation of undesired secondary peaks of the function $R_{sf}[n]$, because these undesired pulses are not only lower, but also less wide, so that the surface of the secondary peaks will be considerably smaller than the surface of the desired peaks.

To further increase the difference between desired peaks and undesired secondary peaks, the expansion means 34 perform a non-linear operation in which large values of A[n] are amplified more than small values of A[n]. This may be effected, for example, by multiplying the function A[n] by the respective value of $m_k$. For the output signal P[n] of the expansion means then holds:

$$P[n] = \begin{cases} \dfrac{a_k \cdot m_k}{\mathrm{MAX}(a_1, \cdots a_q)}, & n = n_k \\ 0, & n \neq n_k \end{cases} \tag{9}$$

It is conceivable that in lieu of (9) a different non-linear operation of A[n] is performed.

The detector 36 removes undesired secondary pulses from the signal P[n]. A first selection may be made by removing the smallest of the pulses P[n] which are mutually less than 2 ms apart. This measure is based on the fact that a pitch period of less than 2 ms is highly unlikely. A final selection is obtained by removing pulses that have an amplitude smaller than a certain fraction of the amplitude of a preceding pulse. The pitch information may be represented by the signal P'[n], while for the values of n when a pitch pulse occurs the signal P'[n] has a first logic value ("1") and for the other values of n has a second logic value ("0").

Figure 3:
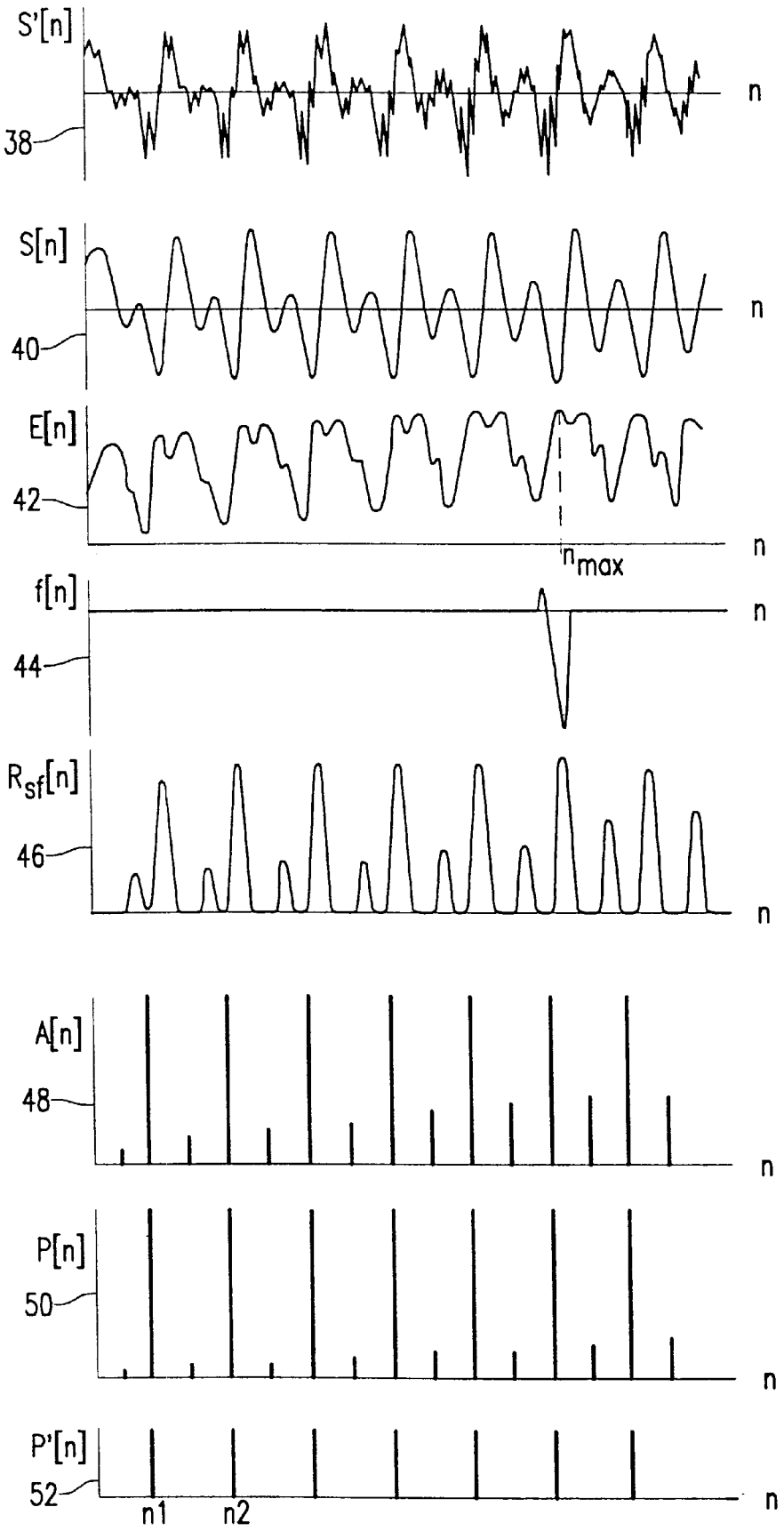
FIG. 3 shows various signal shapes as they may occur in the pitch detector shown in FIG. 2.

In FIG. 3 graph 38 shows the quasi-periodic speech signal S'[n] plotted against n. Graph 38 distinctly shows the (quasi-)periodic characteristic of the speech signal. Graph 40 shows the auxiliary signal S[n] plotted against time. This signal is stripped of the high-frequency components which complicate the pitch detection. Graph 42 shows the value of the running energy function E[n] plotted against n. The maximum value of E[n] is found for $n_{max}$. In graph 44 the characteristic auxiliary signal portion f[n] is shown. This characteristic auxiliary signal portion f[n] is extracted from S[n] in the neighbourhood of $n=n_{max}$.

Graph 46 shows the cross-correlation signal $R_{sf}[n]$ plotted against n. In this graph both the desired peaks and the undesired secondary peaks are visible. In graph 48 is plotted the surface measure A[n] against n. Graph 48 clearly shows that: the distinction between desired peaks and undesired peaks has increased.

In graph 50 the signal P[n] obtained via a non-linear operation from the signal A[n] is shown plotted against n. Here the distinction between the desired pulses and the undesired pulses has become greater. Finally, graph 52 shows the pitch information in the form of a logic signal which has the value "1" for values of n at which a desired pulse occurs. The undesired pulses are removed, as has already been discussed above.

Figure 4:
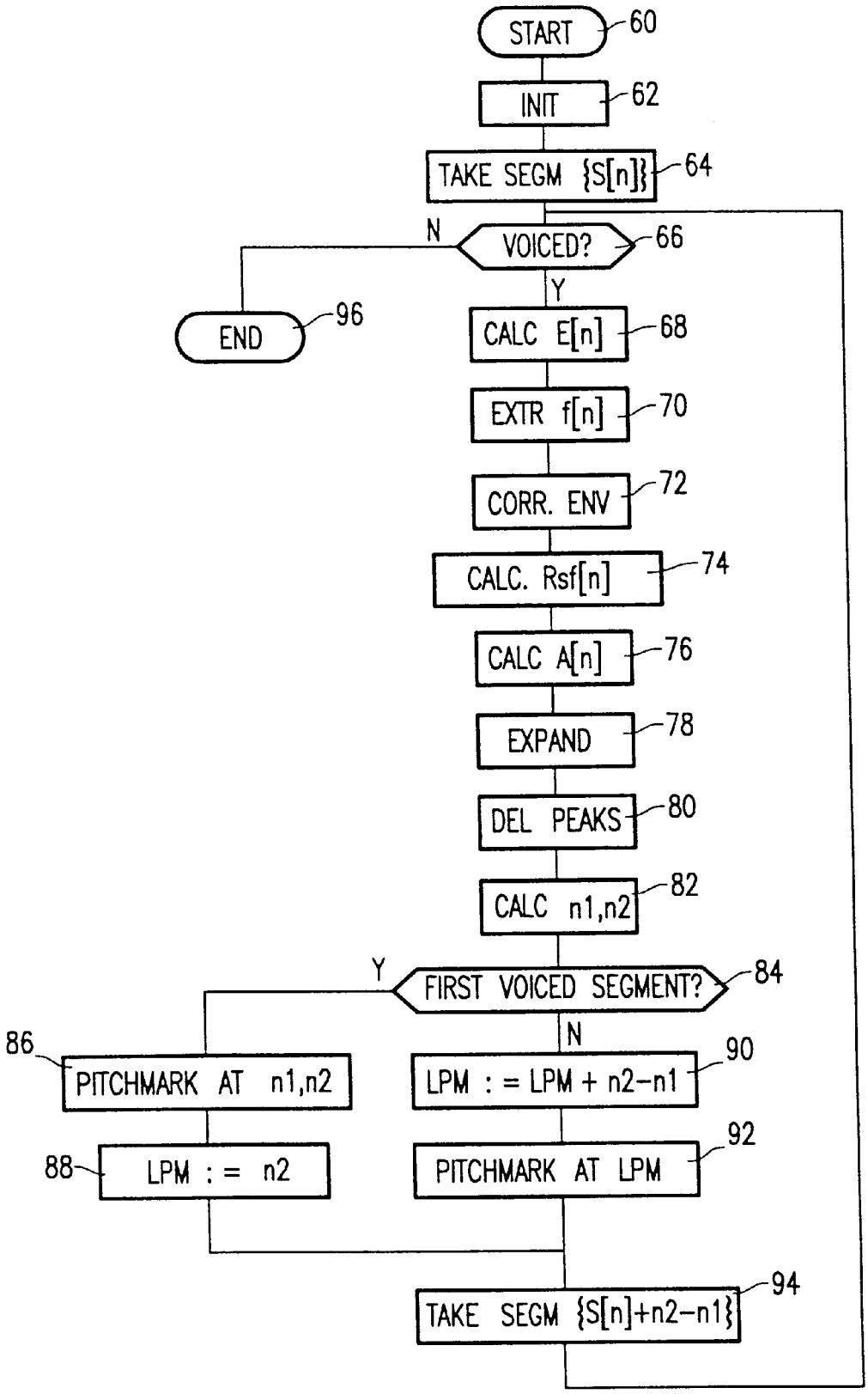
FIG. 4 shows a flow chart of a program for a programmable processor for determining the pitch according to the invention.

In the flow chart shown in FIG. 4 the blocks have the following connotations.

| No. Designation | Connotation |
|---|---|
| 60 START | The procedure is started. |
| 62 INIT | The variables used are initialized. |
| 64 TAKE SEGM {S[n]} | A segment of samples of the auxiliary signal is stored. |
| 66 VOICED | A check is made whether the auxiliary signal is still voiced. |
| 68 CALC E[n] | The running energy function of the stored segment is calculated. |
| 70 EXTR f[n] | The characteristic auxiliary signal portion is extracted from the auxiliary signal. |
| 72 CORR ENV. | An amplitude-controlled auxiliary signal is derived from the auxiliary signal. |
| 74 CALC Rsf[n] | The cross-correlation function $R_{sf}[n]$ is calculated. |
| 76 CALC A[n] | The surface of the peaks in $R_{sf}[n]$ is calculated. |

-continued

| No. Designation | Connotation |
|---|---|
| 78 EXPAND | The signal P[n] is calculated from A[n] via a non-linear operation. |
| 80 DEL PEAKS | The undesired secondary peaks are deleted. |
| 82 CALC $n_1$, $n_2$ | The positions $n_1$ and $n_2$ of the first two pitch pulses in the segment are calculated. |
| 84 FIRST VOICED SEGMENT | A check is made whether the respective segment is the first voiced segment in a part of the speech signal. |
| 86 PITCHMARK AT $n_1$, $n_2$ | For $n = n_1$ and $n = n_2$ the logic value of P[n] is made equal to "1". |
| 88 LPM: = $n_2$ | The position of the last assigned pitch marker is stored. |
| 90 LPM: = LPM + $n_2 - n_1$ | The position for the new pitch marker is calculated and stored. |
| 92 PITCHMARK AT LPM | For n = LPM the logic value of P'[n] is made equal to "1". |
| 94 TAKE SEGM{S[n] + $n_2 - n_1$} | The next segment of samples of the auxiliary signal is taken. |

In the blocks 60 and 62 the program is started if there is a voiced speech signal and the variables used are set to a desired initial value. In block 64 a segment of the signal S[n] is stored. The length of that segment may have a value from 20–40 mS.

In block 66 there is checked whether the segment of S[n] is still voiced. If the signal is no longer voiced, the program is stopped in block 96. The information whether the speech signal is voiced is generated by a procedure (not shown).

In block 68 the running energy function E[n] is calculated. This may be effected according to (1). Subsequently, in block 70 the characteristic auxiliary signal portion is extracted, which may be effected according to (2). In step 72 the amplitude-controlled auxiliary signal $S_{ec}[n]$ is calculated. For this purpose, a measure $S_e[n]$ for the envelope of the auxiliary signal is calculated first. This may be performed according to:

$$S_e[n] = \sum_{i=0}^{L} |S[n-i]| \cdot h[i] \tag{10}$$

In (10), i is a running variable, L is the length of the impulse response of the filter simulated by (10), and h[i] is the impulse response of the filter simulated by (10). A cut-off frequency value proven suitable of the filter simulated by (10) is 25 Hz. A suitable value of L is 121.

An amplitude correction signal $1_c[n]$ is calculated from the signal $S_e[n]$ according to:

$$e_c[n] = \frac{\mathrm{MAX}\{S_e[n]\}}{S_e[n]} \quad 0 \leq n < N \tag{11}$$

With the aid of (11) an amplitude-controlled auxiliary signal $S_{ec}[n]$ is derived according to:

$$S_{ec}[n] = S[n] \cdot e_c[n] \tag{12}$$

There is observed that in the event of a low amplitude of the auxiliary signal, the amplitude correction amplifies undesired secondary peaks in such a way that they are detected as desired peaks. In order to avoid this, the amplitude correction may be switched off if the (average) amplitude of the auxiliary signal drops below a specific threshold value.

In block 74 the correlation function $R_{sf}[n]$ is calculated. This is effected according to (3) or (4). Then, in block 76, the signal A[n] is calculated according to (8) and in block 78 the signal P[n] is calculated by performing the non-linear operation according to (9).

In block 80 the undesired secondary pulses are removed from the signal A[n]. This may be effected in a manner as described already before.

In block 82 the positions $n_1$ and $n_2$ of the first two pulses in the signal P[n] of the current segment are calculated. Then, in block 84, a check is made whether the current segment is the first segment containing voiced speech. If so, a pitch marker is inserted in block 86 into the signal P'[n] at the positions that correspond to $n_1$ and $n_2$. In block 88 the position of the pitch marker inserted last into the signal P'[n] is stored in variable LPM for later use.

If the current segment is not the first segment containing voiced speech, the position of the last pitch mark is calculated in block 90 by adding the value $n_2-n_1$ to the old value of LPM. Then, in block 92, a pitch marker is placed on the position LPM in the signal P'[n].

In block 94 the next segment is taken. This segment is not contiguous to the previous segment, but overlaps same. The beginning of the next segment is shifted by $n_2-n_1$ samples. The reason for this is that in the case of a transition between two contiguous segments, discontinuous changes in the established pitch value may occur in the event of varying characteristic signal portions. By rendering the segments largely overlapping, this is largely avoided.

After block 94, block 66 is returned to for the processing of the new segment.

We claim:

1. A transmission system comprising: a transmitter including an encoder for deriving a coded signal from a quasi-periodic signal, the transmitter being arranged for transmitting the coded signal to a receiver via a transmission medium, the encoder comprising a pitch detector for deriving pitch information from the quasi-periodic signal, wherein the pitch detector comprises selecting means for selecting a characteristic auxiliary portion of an auxiliary signal, that is representative of the quasi-periodic signal, search means for searching for at least a further signal portion of the auxiliary signal that sufficiently corresponds to the characteristic auxiliary signal portion, and means for deriving the pitch information from the instants at which the characteristic auxiliary signal portion and the further signal portion occur.

2. The transmission system as claimed in claim 1, wherein the characteristic auxiliary signal portion comprises a signal portion that has maximum energy over a certain time segment.

3. The transmission system as claimed in claim 2, wherein the duration of the characteristic auxiliary signal portion is smaller than or equal to the briefest occurring pitch period.

4. The transmission system as claimed in claim 2, wherein the search means comprise correlation means for calculating the correlation between the characteristic auxiliary signal portion and the auxiliary signal, the pitch information being represented by the position of the peaks in the correlation function.

5. The transmission system as claimed in claim 1, wherein the duration of the characteristic auxiliary signal portion is smaller than or equal to the briefest occurring pitch period.

6. The transmission system as claimed in claim 3, wherein the search means comprise correlation means for calculating the correlation between the characteristic auxiliary signal portion and the auxiliary signal, the pitch information being represented by the position of the peaks in the correlation function.

7. The transmission system as claimed in claim 1, wherein the search means comprise correlation means for calculating the correlation between the characteristic auxiliary signal portion and the auxiliary signal, the pitch information being represented by the position of the peaks in the correlation function.

8. The transmission system as claimed in claim 7, wherein the pitch detector comprises means for calculating the surface of the peaks in the correlation function, the pitch detector deriving the pitch information from the surface of the peaks of the correlation function plotted against time.

9. The transmission system as claimed in claim 8, wherein the pitch detector comprises expansion means for converting the surface of the peaks of the correlation function into expanded surface values of the peaks of the correlation function.

10. Encoder for deriving a coded signal from a quasi-periodic signal, the encoder comprising a pitch detector for deriving pitch information from the quasi-periodic signal, characterized in that the pitch detector comprises selecting means for selecting a characteristic auxiliary portion of an auxiliary signal, which auxiliary signal is representative of the quasi-periodic signal, search means for searching for at least a further signal portion of the auxiliary signal that sufficiently corresponds to the characteristic auxiliary signal portion, and means for deriving the pitch information from the instants at which the characteristic auxiliary signal portion and the further signal portion occur.

11. The encoder as claimed in claim 10, wherein the characteristic auxiliary signal portion comprises a signal portion that has maximum energy over a certain time segment.

12. Arrangement for calculating the period of a quasi-periodic signal, comprising selecting means for selecting a characteristic auxiliary portion of an auxiliary signal which is representative of the quasi-periodic signal, search means for searching for at least a further signal portion of the auxiliary signal that sufficiently corresponds to the characteristic auxiliary signal portion, and means for deriving the pitch information from the instants at which the characteristic auxiliary signal portion and the further signal portion occur.

13. Coding method for deriving a coded signal from a quasi-periodic signal which comprises: selecting a characteristic auxiliary portion of an auxiliary signal which auxiliary signal is representative of the quasi-periodic signal, searching at least for a further signal portion of the auxiliary signal that sufficiently corresponds to the characteristic auxiliary signal portion, and deriving pitch information from the instants at which the characteristic auxiliary signal portion and the further signal portion occur.

14. A pitch detector for deriving pitch information from a quasi-periodic signal comprising:

means for deriving from the quasi-periodic signal an auxiliary signal representative of the quasi-periodic signal, energy measuring means responsive to the auxiliary signal so as to produce a signal E[n] calculated as a running energy function of a segment of the auxiliary signal, selecting means responsive to the auxiliary signal and to the signal E[n] thereby to select a characteristic auxiliary portion of the auxiliary signal, search means responsive to the characteristic auxiliary signal portion and to the auxiliary signal for searching for at least a further signal portion of the auxiliary signal that sufficiently corresponds to the characteristic auxiliary signal portion, and means coupled to an output of the search means for deriving the pitch information from the instants at which the characteristic auxiliary signal portion and the further signal portion occur.

15. The pitch detector as claimed in claim 14 wherein the search means comprise correlation means for calculating the correlation between the characteristic auxiliary signal portion and the auxiliary signal, the pitch information being represented by the position of peaks in the correlation function.

16. The pitch detector as claimed in claim 15 wherein the pitch information deriving means comprises means for calculating the surface of the peaks in the correlation function, the pitch information being derived from the surface of the peaks of the correlation function plotted against time.

17. The pitch detector as claimed in claim 16 further comprising expansion means coupled to an output of the means for calculating the surface peaks in the correlation function for converting the surface of the peaks of the correlation function into expanded surface values of the peaks of the correlation function.

18. The pitch detector as claimed in claim 15 wherein the pitch information deriving means comprises an integrator coupled to an output of the correlation means.

19. The pitch detector as claimed in claim 14 wherein the selecting means supplies a characteristic auxiliary signal portion that comprises a signal portion that has maximum energy over a certain time segment.

20. The pitch detector as claimed in claim 14 further comprising:

an envelope detector responsive to said auxiliary signal, and a controllable amplifier having input means that receive said auxiliary signal and an output signal of the envelope detector and supplies to the search means an amplitude controllable auxiliary signal.

* * * * *